United States Patent [19]

Chance et al.

[11] 3,936,953

[45] Feb. 10, 1976

[54] AIR IMPINGEMENT SYSTEM

[75] Inventors: James L. Chance, Rockford; Shu Tang Han, South Beloit, both of Ill.

[73] Assignee: Beloit Corporation, Beloit, Wis.

[22] Filed: Feb. 19, 1975

[21] Appl. No.: 550,971

Related U.S. Application Data

[63] Continuation of Ser. No. 405,142, Oct. 10, 1973, abandoned.

[52] U.S. Cl. ..... 34/160; 34/122; 34/156; 34/114

[51] Int. Cl.[2] ..... F26B 13/00

[58] Field of Search ..... 34/114, 122, 155–160, 34/23

[56] References Cited

UNITED STATES PATENTS

| | | | |
|---|---|---|---|
| 3,085,347 | 4/1963 | Justus | 34/122 |
| 3,199,224 | 8/1965 | Brown | 34/160 |
| 3,398,466 | 8/1968 | Brown | 34/160 |
| 3,525,164 | 8/1970 | Brown | 34/160 |
| 3,800,438 | 4/1974 | Meier-Windhurst | 34/156 |

*Primary Examiner*—Kenneth W. Sprague
*Assistant Examiner*—James C. Yeung
*Attorney, Agent, or Firm*—Dirk J. Veneman; Bruce L. Samlan; Gerald A. Mathews

[57] ABSTRACT

Method and apparatus for drying a moving web utilizing one or more air caps each including an apertured plate together with a high pressure plenum which is arranged to deliver high pressure air through the apertures in the plate to impinge against the web. The geometry of the plates, their spacing from the web and the positioning of exhaust means are correlated to provide a minimum amount of cross flow interference thereby improving the heat transfer and ultimately the efficiency of the drying operation.

10 Claims, 7 Drawing Figures

Fig. 2
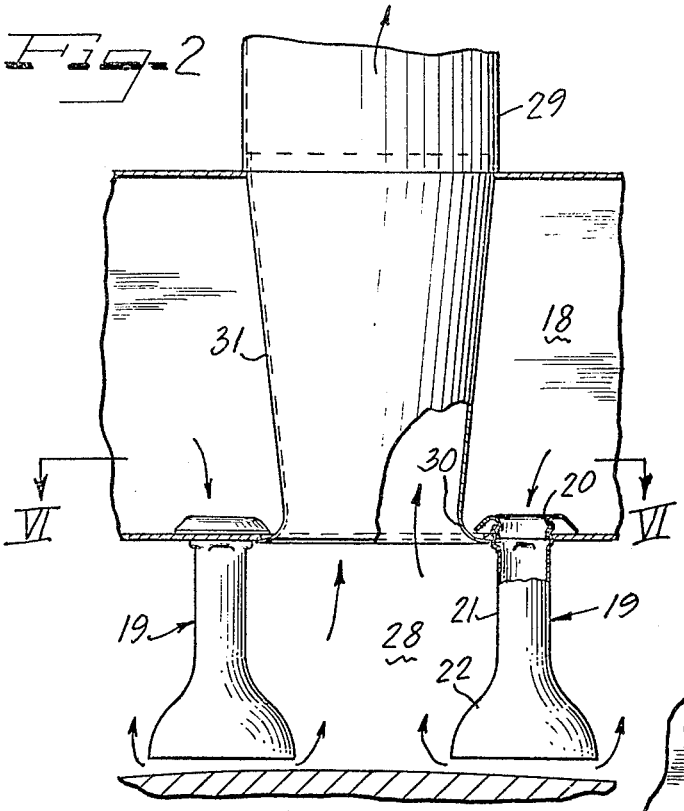
Fig. 3
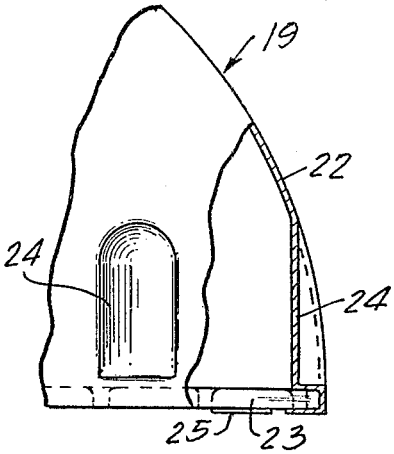
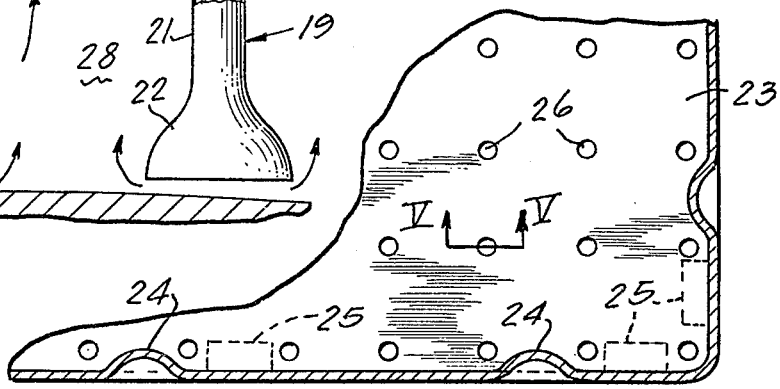
Fig. 4
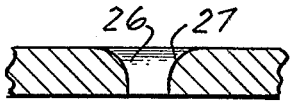
Fig. 5
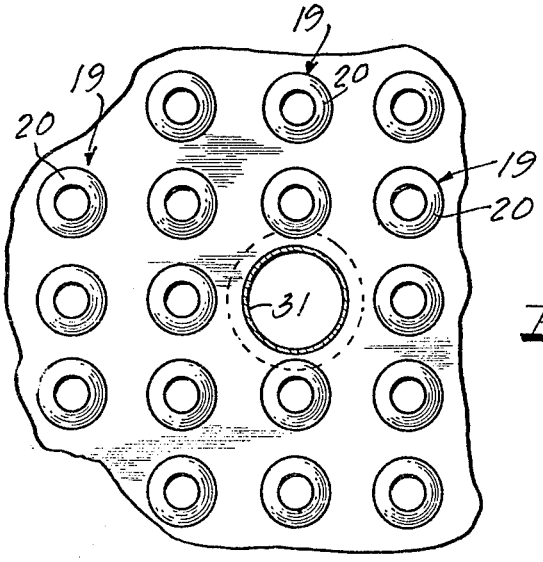
Fig. 6

AIR IMPINGEMENT SYSTEM

This is a continuation of application Ser. No. 405,142, filed Oct. 10, 1973, now abandoned.

BACKGROUND OF THE INVENTION

1. Field of the Invention

This invention is in the field of drying by means of impingement flow of high pressure heated air, with provisions being made for exhausting the impinging air streams behind the impingement jets so that the impinging air streams are directed to an exhaust chamber at a relatively low velocity and without excessive pressure drop.

2. Description of the Prior Art

Impingement flow, that is, flow directed normal to the surface has been recognized as an efficient means for heating or cooling. In recent years, this method of heat transfer has been used in the paper industry for drying of paper. Representative patents in this field are U.S. Pat. Nos. 3,163,502; 3,167,408; and 3,447,247 all owned by the assignee of the present invention.

Air impingement drying is particularly suited for drying of lightweight grades of paper such as tissue paper and for drying coated paper. These applications require higher rates of heat transfer because of the limited drying length and the requirements of high speed operation.

There are various types of air impingement devices in use on paper drying apparatus. One of these types uses slotted nozzles and another incorporates round holes to provide jet orifices for impingement purposes. The slot nozzle arrangements have the disadvantage of requiring a relatively complex system of air removal ducts between the slots. Slot arrangements are also characterized by inefficient performance as measured by the heat transfer coefficient obtainable for a given expenditure of air blower horsepower. In addition, relatively small spacings between the impingement surface and the slot nozzles are required in order to obtain good heat transfer results.

Some of the disadvantages inherent in the slot nozzle arrangement are eliminated in the round hole impingement systems. For example, the heat transfer coefficient is relatively unaffected by the distance from the nozzle to the impingement surface as long as there is a proper ratio of the impingement distance to the hole diameter. Also when using round impingement holes, it becomes easier to incorporate air exhaust systems sets of the round holes.

With the demand for increased machine speeds, adequate drying must either be accomplished by raising the drying rate or the heat transfer length. Increased drying lengths require additional capital expenditure for already expensive drying equipment. In tissue drying applications, where the wet web is pressed on the surface of a large diameter rotating drum, the web must be dried in less than one revolution. Typically, such a drying system employs a large diameter steam filled cylinder surrounded by a high temperature, high velocity air impingement cap. However, these steam filled cylinders are already operating at about the highest practical steam pressures possible and are being built at about the largest practical diameter possible. Therefore, any further increases in speed must come from increased heat transfer rates from air impingement. At the present time, air caps are being operated at temperatures of about 800°F. In order to achieve higher temperatures, expensive high temperature alloys must be employed. In addition, at these higher temperatures problems are encountered in maintaining the dimensional stability of the equipment and as impingement temperatures get higher, more problems will be encountered with drying uniformity.

Inasmuch as air caps in use today in the paper industry are already operating at about the limit of temperature, it becomes necessary to increase the convective heat transfer coefficient in order to increase the heat transfer rate and consequently the evaporation rate. In paper drying applications, a large convective heat transfer coefficient helps to alleviate any nonuniform drying problems. One method of increasing the convective heat transfer coefficient is simply by increasing the impingement velocity. However, for a given system configuration an increase in impingement velocity can only be obtained at the expense of increased fan horespower. Increases in fan horsepower represent both increased capital cost for equipment and also increased operating expense. Therefore, an upper limit exists whereby increases in heat transfer rate by adding additional fan horsepower are no longer considered feasible.

Another means of increasing the heat transfer coefficient is to increase the number of impinging jets, that is, by increasing the open area of the impingement plate. Published literature indicates that after the open area is increased beyond approximately 2%, no further gains in the heat transfer rate are obtainable. It was thought that the inability to improve the heat transfer rate was caused by interference between adjacent impinging jets, that is, as the open area was increased and the impingement jets became closer and closer together, it was thought that the adjacent jets interfered with each other thereby reducing the heat transfer coefficient.

More recently published experimental data indicates that this reduction in heat transfer coefficient is not caused by interference between adjacent jets but rather by cross flow interference from the spent air. The jets after impingement must travel to an opening to be exhausted and this means that the spent air must travel across adjacent jets before reaching an exhaust outlet. This exhaust cross flow interference can actually cause the impinging jet to be bent at an angle which is not perpendicular to the surface of impingement. Any deviation of the impingement jet from a line normal to the heated or cooled surface results in a degradation of the heat transfer rate. Consequently, it becomes important to eliminate or reduce cross flow interference if the average heat transfer coefficient is to be increased.

SUMMARY OF THE INVENTION

The present invention is directed to a method and apparatus for impingement drying involving a correlation between the variables involved in such drying as well as structural features which minimize cross flow interference between adjoining jet orifices. One of the features of structure involved is the provision of a support housing for the apertured plate which is of lesser cross-sectional area than the plate so that the area behind the individual plates serves as an extended area exhaust region in which the impinging air streams are directed at a relatively low velocity and without an excessive pressure drop. Another structural feature involves the use of an array consisting of a plurality of apertured plates with exhaust regions located about the entire periphery of each plate so that any given aperture in the plate is not spaced an excessive distance from an exhaust region. Also contributing to the improved efficiencies of the present invention are an improved aperture configuration. For best results, we have found it desirable to space each jet aperture an equidistant amount from the next adjacent jet aperture as by providing a pattern of apertures which is a series of squares or a series of equilateral triangles.

As far as operating parameters are concerned, we have found that the open area of the apertures in the plate should constitute no more than about 3% of the area of the plate and that the diameter of the apertures should preferably be within the range from about 1/16 inch to about ¾ inch. It is also important to correlate the ratio of the distance of the aperture from the surface of the web to the diameter of the aperture such that with greater open areas, the ratio of distance to diameter is lower.

Basically, the present invention provides small diameter impingement holes over the entire impingement plate to achieve large heat transfer rates per unit area. The arrangement is such that there is a relatively large open area to obtain a large number of heat transfer spots. Exhaust openings are provided on all sides of the impingement plate to minimize any cross flow interference. Another feature involves the use of a central high pressure plenum to feed each of the impingement boxes uniformly. Other improvements are achieved by utilizing tapered impingement boxes and smoothly contoured inlets for feeding the high pressure air through the apertured plates.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 2 is a fragmentary vertical cross-sectional view of the bell-shaped support means for the perforated plate;

FIG. 3 is a fragmentary view partly in elevation and partly in cross-section of one of the bell structures as shown in FIG. 2;

FIG. 4 is a fragmentary cross-sectional view of the type of apertured plate used in the structure of FIGS. 2 and 3;

FIG. 5 is a fragmentary cross-sectional view on an enlarged scale taken substantially along the line V—V of FIG. 4;

FIG. 6 is a cross-sectional view taken along the line VI—VI of FIG. 2; and

DESCRIPTION OF THE PREFERRED EMBODIMENTS

Figure 1:
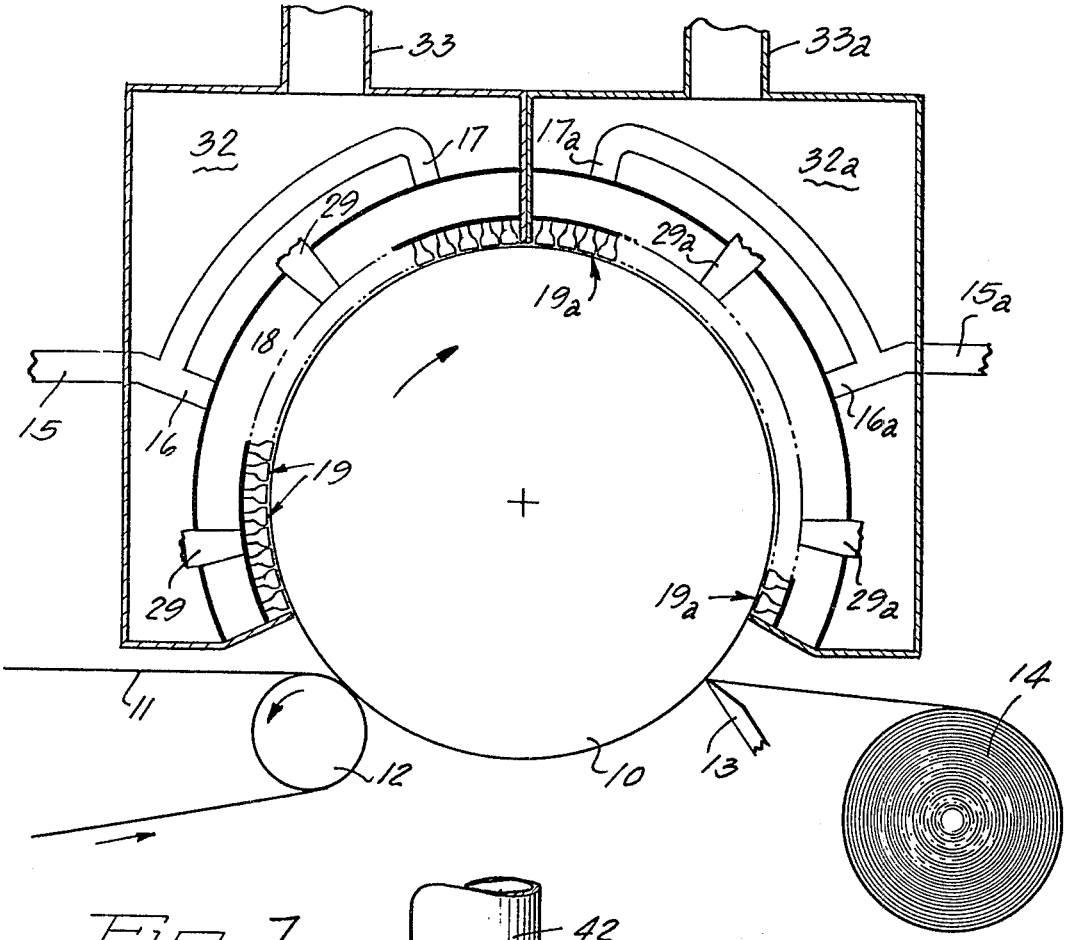
FIG. 1 is a somewhat schematic view illustrating an air cap system of the present invention associated with a large diameter Yankee drier drum.

Before proceeding with a detailed description of the drawings, it would be well to review the inter-relationship between the variables involved in an impingement drying process. As mentioned previously, cross flow interference from the spent air provides a significant reduction in the average heat transfer coefficient of the system. One means of alleviating the cross flow interference would be to provide exhaust openings at or near impinging jets, but this results in a very complex and expensive system. It is also desirable to provide as many heat transfer spots as possible. For a given open area this can be accomplished by incorporating small diameter impingement holes. It has been found that small diameter holes are more susceptible to cross flow interference. As the cross flow velocities are increased, the small diameter jet can easily be bent or even destroyed by the cross flow. Larger diameter jets are less susceptible to this interference because of the larger momentum associated with the jet.

Another problem associated with utilizing small diameter jets is that the distance from the impingement plate to the surface to be heated or cooled must be kept at a relatively small value in order to avoid a reduction in heat transfer. At very small spacings, a pressure buildup can occur at locations away from the exhaust openings. This results in the establishment of a large pressure drop between the area at which the jet impinges and the point at which the spent air is exhausted. At points where the pressure is high impingement velocities are low, and at points where the pressure is low higher impingement velocities occur. The resason for this is that the plenum pressure is constant and the impingement velocity is controlled by the pressure differential across the impingement plate. This results in nonuniform heat transfer and ultimately nonuniform drying.

We have now managed to correlate these inter-acting variables and provide an integrated system in which high heat transfer rates are obtained with a minimum of cross flow interference into the exhaust openings. Through the particular arrangement to be discussed, we have managed to minimize the pressure gradient between jets located at varying distances from the exhaust openings.

Turning to specifics, we have found that the open area of the apertures in the impingement plate should constitute no more than about 3% of the area of the plate. We have also found that the diameter of the apertures should be in the range from about 1/16 inch to about ¾ of an inch. Furthermore, our work has determined that the ratio of the distance of an aperture from the surface of the web to the diameter of the aperture for best results, should be in accordance with the following table:

TABLE I

| Open area | Ratio of distance/ diameter |
|---|---|
| up to 1% | 3 - 6 |
| greater than 1% up to 2% | 2 - 5 |
| greater than 2% up to 3% | 2 - 4 |

In order to secure uniform heat transfer across the web, it is desirable that the apertures be symmetrically disposed within the plate, with each aperture being equidistant from the adjacent apertures. We accordingly prefer to provide a pattern of apertures which constitutes a series of squares or a series of equilateral triangles.

The plates in which the apertures are located are preferably substantially square. In order to provide access of the centrally disposed apertures in the plate to the peripheral exhaust area surrounding the plate, it is advisable to make the length of one side of the square plate no more than about 1.8 times the diameter of an aperture divided by the open area. As a specific example, for a plate having apertures of ⅛ inch in diameter and an open area of 0.0276 (2.76%) of the maximum length of a side of the square plate would be about 8.15 inches.

Turning now to a specific description of the drawings, in FIG. 1 there is illustrated a drying assembly of the type which is used for drying lightweight webs such as tissue paper and the like. The drying assembly includes a large diameter steam heated Yankee-type drier roll 10 to which a web of tissue or the like is applied by means of a conveyor belt 11 trained around a roller 12. As illustrated in FIG. 1, the web of tissue travels around a major portion of the periphery of the drum 10 and is removed therefrom by means of a doctor blade 13 and wound up on a takeup roll 14.

The drying assembly of FIG. 1 includes a pair of air cap assemblies which are positioned in close proximity to the surface of the traveling web and extend the full width of the web. High pressure heated air is applied from a source (not shown) to an inlet manifold 15 which delivers the air to conduits 16 and 17 located in spaced relation along the arcuate periphery of the air cap assembly, thereby providing a high pressure plenum 18 from which a plurality of bell-shaped plate supports 19 are fed. The configuration of these supports 19 is best illustrated in FIGS. 2 to 6 of the drawings from which it will be seen that the supports 19 are formed with a rounded entrance portion 20, a relatively small diameter throat portion 21 and a flared bell-shaped bottom portion 22 in which there is located an apertured plate 23. A series of dimples 24 and tabs 25 are provided at the periphery to confine the plate 23 tightly within the base of the bell-shaped portion.

The plate 23 contains apertures 26 in symmetrically disposed array which constitutes a square pattern as illustrated in FIG. 4. The inlet end of each of the apertures 26, as illustrated in FIG. 5, has a contoured entrance 27 to minimize flow irregularities and turbulence.

The high temperature high pressure air passing through the apertures 26 in the plate 23 impinges against the web on the surface of the drum 10 with very substantial velocities on the order of 20,000 to 30,000 feet per minute. A typical web speed of light-weight paper would be about 4,000 to 6,500 feet per minute. The impinging air after striking the surface of the web is deflected around the periphery of each of the bell-shaped supports 19 into the region between the relatively narrow throats 21 which region is an exhaust region identified at reference numeral 28 in the drawings. The exhaust region 28 is in fluid communication with an exhaust conduit 29 as illustrated in both FIGS. 1 and 2. Each of the exhaust conduits 29 has a rounded inlet portion 30 and an outwardly tapered body portion 31, the function of which is to provide as low a pressure drop as possible and as little turbulence as possible in the flow of the exhausted air. The exhausted air is directed into a plenum chamber 32 from where it is removed by means of an exhaust conduit 33.

The other air cap structure illustrated in FIG. 1 is substantially identical to that described and the corresponding elements of this structure are identified with the same reference numerals as used previously, followed by the subscript *a*.

Figure 7:
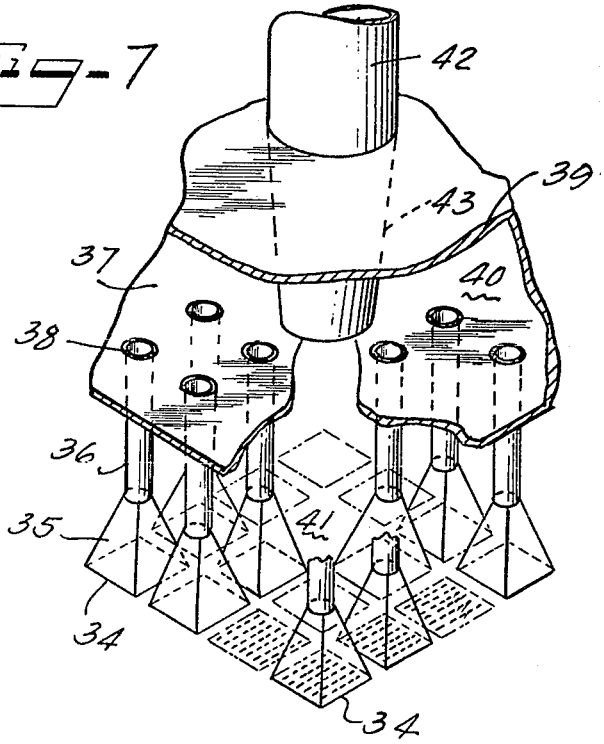
FIG. 7 is a schematic view, partly broken away illustrating another air cap structure produced according to the present invention.

Another arrangement of apertured plates for high velocity impingement drying is illustrated in FIG. 7 of the drawings. In the form of the invention there illustrated, a plurality of generally square plates 34 each having an array of apertures arranged in a square pattern are received in support means including inwardly curved side walls 35 which fasten to relatively small diameter pipes 36. The ends of the pipes 36 are fastened to a wall 37, the ends having a smoothly rounded lip 38. A wall 39 is spaced from the wall 37 to provide a high pressure plenum chamber 40 therebetween for introducing high pressure heated air through the pipes 36 and thence through the perforated plates 34. The complete array may include twenty-four to thirty-six plates or so and centrally of the array of plates there is left a blank exhaust area 41. An exhaust conduit 42 having a tapered end portion 43 communicates with the exhaust area 41 to vent the exhaust air therefrom.

With both of the forms of the invention shown, it will be apparent that the impingement air is directed rearwardly about the entire peripheries of the plates to a single exhaust means thereby providing a relatively large area for exhaust flow resulting in a relatively low exhaust velocity and the absence of an excessive pressure drop.

Various types of plenum arrangements may be made to take advantage of the improvements of the present invention. For example, the air exhausted into the exhaust area behind each plate can be directed to a large exhaust area located between adjoining plenums where the combined exhausts from the adjoining plenums are combined and vented.

Calculations have determined that air cap structures including the improvements of the present invention are considerably more efficient for drying purposes than other air caps presently available. These calculations were based on drying a tissue paper having a weight of 12 pounds for 3,000 square feet and an initial moisture content of 1.5 pounds of water for every pound of fibers. The air caps would be located about a Yankee drier of 16 feet in diameter and occupy 270 ° of the circumference of the drier drum. In both cases, the steam temperature within the drier drum was taken as 345°F, and the impinging air was to be at a temperature of 800°F. In both cases, the impingement velocity was assumed to be 25,000 feet per minute.

With a commercially available air cap device, the jets have an open area of 0.0147 (1.47%) and a jet diameter of 0.375 inch. The vertical spacing of the jets is 1 inch from the surface of the web. The impingement heat transfer coefficient was calculated to be 56.1 BTU per hour, per square foot, per degree F. Under these conditions, the web could be dried at a machine speed of 5,154 feet per minute.

With the new design of air cap, the open area is taken as 0.0276 (2.76%) and the jet diameters at 0.125 inches. The vertical spacing from the jet to the web was to be ½ inch. It was calculated that under these conditions, the impingement heat transfer coefficient would be 83.7 BTU per hour, per square foot, per degree F. Under these circumstances, the paper could be dried to the same degree of moisture content at a machine speed of 6,873 feet per minute, thereby increasing the drying speed by a factor of more than 30%.

At the same open area and impingement velocity, the heat transfer coefficient for the ⅛ inch jet array is approximately 30% higher than the ⅜ inch jet array at the same power consumption.

Thus, with the arrangement above described, increased heat transfer from the drying air to the moist web, and hence increased evaporation is achieved. A reduction of the deleterious effects of cross flow upon the heat transfer coefficient is achieved. In partial summary of the above, the openings have a diameter D in range of 1/16 inch to ¾ inch. The distance Z of the openings to the supporting surface is related to the size of orifice openings so that the ratio of Z:D is no greater than 6. By increasing the spacing between the orifices and the support, the cross flow velocities of the escaping air are decreased. It has been found that heat transfer is relatively unaffected by vertical distance as long as the ratio of Z:D is equal to or less than 6.

We claim as our invention:

1. An apparatus for drying a moving web comprising at least one air cap having a width corresponding to the width of the web to be dried, each air cap including at least one apertured plate, hollow support means for positioning the plate in relatively close proximity to the web, a high pressure plenum connected to said support means for delivering high pressure air through the apertures in said plate to impinge against said web, said support means having a throat of lesser cross-sectional area than said plate between said plate and said plenum, thereby providing an exhaust region of extended area behind each plate into which the impinging air streams are directed at a relatively low velocity and without an excessive pressure drop, the open area of the apertures in said plate constituting no more than about 3% of the area of said plate, the ratio of the distance of the apertures from the surface of the web to the diameter of the apertures being in accordance with the following table:

| Open area | Ratio of distance/ diameter |
|---|---|
| up to 1% | 3 – 6 |
| greater than 1% up to 2% | 2 – 5 |
| greater than 2% up to 3% | 2 – 4. |

2. The apparatus of claim 1 in which the diameter of the apertures is in the range from about 1/6 inch to about ¾ inch.

3. The apparatus of claim 1 in which a given aperture in each plate is spaced equidistant from each of its adjoining apertures.

4. An apparatus for drying a moving web comprising a high pressure plenum, a plurality of apertured plates extending across the width of the web to be dried, conduit means enclosing each of said plates and connecting the same to said plenum, each of said plates being spaced from adjoining plates along its entire periphery thereby providing exhaust channels for air streams impinging against said web, said conduit means having a cross-sectional area of lesser extent than the cross-sectional area of its associated plate inwardly of said plate in the direction of said plenum thereby providing an extended exhaust space between said plates and said plenum, and a common exhaust conduit communicating with said exhaust space, said conduit extending through and beyond said plenum, the open area of the apertures in said plate constituting no more than about 3% of the area of said plate, the ratio of the distance of the apertures from the surface of the web to the diameter of the apertures being in accordance with the following table:

| Open area | Ratio of distance/ diameter |
|---|---|
| up to 1% | 3 – 6 |
| greater than 1% up to 2% | 2 – 5 |
| greater than 2% up to 3%. | 2 – 4 |

5. The apparatus of claim 4 in which the apertures in said plates are smoothly contoured to reduce flow disturbances.

6. The apparatus of claim 4 in which said plates are substantially square and the length of one side of the square is no more than about 1.8 times the diameter of an aperture divided by the open area.

7. An apparatus for drying a moving web comprising a high pressure plenum, a plurality of apertured plates extending across the width of the web to be dried, conduit means enclosing each of said plates and connecting the same to said plenum, each of said plates being spaced from adjoining plates along its entire periphery thereby providing exhaust channels for air streams impinging against said web so that air exhausting between the plates prevents cross flow interference of spent air with air streams, said conduit means having a cross-sectional area of lesser extent than the cross-sectional area of its associated plate inwardly of said plate in the direction of said plenum thereby providing an extended exhaust space between said plates and said plenum, and a common exhaust conduit communicating with said exhaust space, said conduit extending through and beyond said plenum.

8. An apparatus for drying a moving web constructed in accordance with claim 7:

wherein said openings have a diameter in the range of 1/16 to ¾ and have an area of no greater than 3% of the area of the plate.

9. An apparatus for drying a moving web constructed in accordance with claim 7:

wherein said plate apertures comprise openings having a diameter D and having a distance Z from the web, the ratio Z:D being no greater than 6.

10. An apparatus for drying a moving web constructed in accordance with claim 7:

wherein the ratio of the distance of the apertures from the surface of the web to the diameter of the apertures is in accordance with the following table:

| Open Area | Ratio of distance/diameter |
|---|---|
| up to 1% | 3 – 6 |
| greater than 1% up to 2% | 2 – 5 |
| greater than 2% up to 3% | 2 – 4. |

* * * * *